US005429767A

United States Patent [19]

Zelger

[11] Patent Number: 5,429,767

[45] Date of Patent: Jul. 4, 1995

[54] STORAGE-STABLE WHITENER FORMULATION

[75] Inventor: Josef Zelger, Riehen, Switzerland

[73] Assignee: Ciba-Geigy Corporation, Ardsley, N.Y.

[21] Appl. No.: 168,014

[22] Filed: Dec. 15, 1993

[30] Foreign Application Priority Data

Dec. 22, 1992 [CH] Switzerland ..... 3940/92

[51] Int. Cl.[6] ..... C11D 1/18; C11D 3/26; C11D 7/32

[52] U.S. Cl. ..... 252/174.17; 252/174.25; 252/301.21; 252/301.34; 252/301.35; 252/179; 252/543

[58] Field of Search ..... 252/174.17, 174.25, 252/301.21, 301.23, 301.34, 301.35, 543, 179

[56] References Cited

U.S. PATENT DOCUMENTS

| | | | |
|---|---|---|---|
| 4,323,396 | 4/1982 | Ehl et al. | 106/23 |
| 4,326,982 | 4/1982 | Neumann et al. | 252/301 |
| 4,752,298 | 6/1988 | Burglin et al. | 8/527 |
| 4,787,912 | 11/1988 | Abel et al. | 8/582 |
| 5,030,244 | 7/1991 | Neumann et al. | 8/526 |
| 5,051,111 | 9/1991 | Anceschi et al. | 8/648 |
| 5,076,968 | 12/1991 | Fringeli | 252/543 |
| 5,205,960 | 4/1993 | Kristopeit et al. | 252/174.24 |
| 5,234,617 | 8/1993 | Hunter et al. | 252/542 |

FOREIGN PATENT DOCUMENTS

| | | | |
|---|---|---|---|
| 0008669 | 3/1980 | European Pat. Off. | C11D 3/42 |
| 0033913 | 8/1981 | European Pat. Off. | C09B 67/20 |
| 0235080 | 9/1987 | European Pat. Off. | D06P 1/62 |
| 0323399 | 7/1989 | European Pat. Off. | D06L 3/12 |
| 0345765 | 12/1989 | European Pat. Off. | C09B 67/06 |
| 0542677 | 5/1993 | European Pat. Off. | D06L 3/12 |
| 2367803 | 5/1978 | France | C09B 23/14 |

OTHER PUBLICATIONS

*The New Encyclopaedia Britannica,* 1986 vol. 2, p. 114 (month not available).

*Primary Examiner*—Paul Lieberman
*Assistant Examiner*—Patricia L. Hailey
*Attorney, Agent, or Firm*—Kevin T. Mansfield

[57] ABSTRACT

The invention relates to storage-stable formulations comprising anionic fluorescent whitening agents, an anionic polysaccharide, one or more dispersants and water as well as further optional components. These formulations are especially suitable for the preparation of liquid detergent compositions.

13 Claims, No Drawings

STORAGE-STABLE WHITENER FORMULATION

The present invention relates to storage-stable whitener formulations, to a process for their preparation and to the use thereof.

Fluorescent whitening agents are usually preferably marketed in the form of aqueous solutions or suspensions. Such formulations are prepared by suspending the moist filter cake or the dry powder of the fluorescent whitening agent in water. Dispersants and thickeners are then added to the resultant suspensions to enhance homogeneity, wettability and stability. Besides these auxiliaries, an electrolyte is often also added. However, the auxiliaries used hitherto have been unable to prevent sedimentation and/or a substantial increase in the viscosity of the fluorescent agent whitening agent during prolonged storage, especially at high temperatures.

Surprisingly, it has now been found that storage-stable formulations of concentrated aqueous whitener are obtained by adding to the aqueous suspension of the fluorescent whitening agents minor amounts of an anionic polysaccharide in conjunction with dispersants. Such suspensions form virtually no deposits during storage. In addition to their good sedimentation properties, the suspensions remain homogeneous during storage. It is also an important feature that the novel suspensions contain almost no corrosive electrolytes such as sodium chloride, as these can cause corrosion problems.

The whitener formulations of this invention accordingly comprise:

a) 15 to 60% by weight, preferably 15 to 45% by weight, based on the total weight of the formulation, of an anionic fluorescent whitening agent of formula

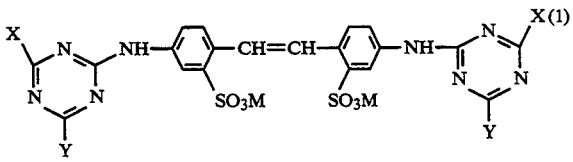

wherein X and Y may be identical or different and are a mono- or di-substituted amino group or an unsubstituted or a mono- or di-substituted alkoxy group, and M is a hydrogen atom or a salt-forming cation, b) 0.05 to 25% by weight, based on the total weight of the formulation, of an electrolyte or a mixture of electrolytes;

c) 0 to 1% by weight, based on the total weight of the formulation, of an anionic polysaccharide or mixture of polysaccharides;

d) 0.01 to 20% by weight, based on the total weight of the formulation, of one ore more than one dispersant;

e) further optional components; and f) water to make up 100% by weight.

These novel formulations are suspensions and are stable for at least 6 months in the temperature range from −5° C. to 60° C., preferably for at least 6 months in the temperature range from 0° C. to 40° C.

In the compounds of formula (1), secondary or tertiary amino is suitably phenylamino substituted by one or more members selected from the group consisting of $C_1$-$C_4$alkyl, $C_1$-$C_4$alkoxy, sulfo, halogen, cyano, or carboxy; morpholino, piperidino, methylamino, ethylamino, propylamino, butylamino, β-hydroxyethylamino, β-hydroxypropylamino, β-cyanoethylamino, dimethylamino, diethylamino, dipropylamino, bis(β-hydroxyethylamino), N-methyl-N-ethylamino, N-methyl-N-β-hydroxyethylamino, N-ethyl-N-β-hydroxyethylamino, N-methyl-N-β-hydroxypropylamino, N-ethyl-N-β-hydroxypropylamino, benzylamino, N-β-hydroxyethylbenzylamino, cyclohexylamino, N-ethyl-cyclohexylamino, 2-methoxyethylamino, 2-ethoxyethylamino, N-methyl-2-methoxyethylamino and 3-methoxypropylamino.

Unsubstituted or mono- or disubstituted alkoxy is typically methoxy, ethoxy, n-propoxy, isopropoxy, butoxy, β-hydroxyethoxy, β-methoxyethoxy and β-ethoxyethoxy.

Particularly interesting fluorescent whitening agents are those of formula (1), wherein X and Y are identical or different and are phenylamino which may be mono- or di-substituted by alkyl of 1 or 2 carbon atoms. Further preferred substituents represented by X and Y are morpholino, alkylamino of 1 to 4 carbon atoms which may be substituted by hydroxyl; or alkoxy of 1 to 4 carbon atoms.

Illustrative examples of the fluorescent whitening agents of formula (1) are those of formulae

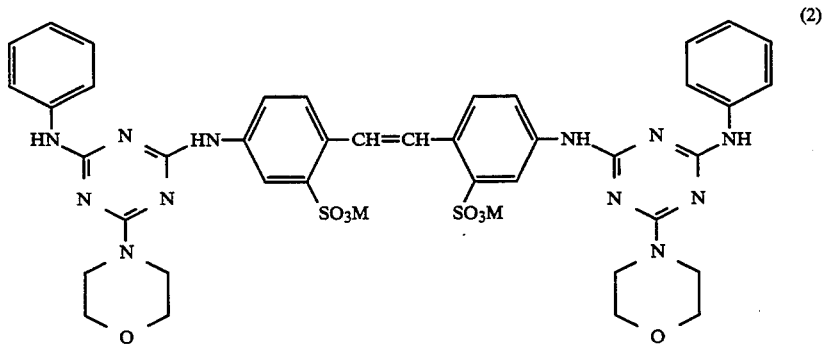

(2)

wherein M is an alkali metal ion, with the proviso that, in the case of said fluorescent whitening agent, the formulation will conveniently comprise 0.05 to 5% by weight, based on the total weight of the suspension, of a strong electrolyte; and

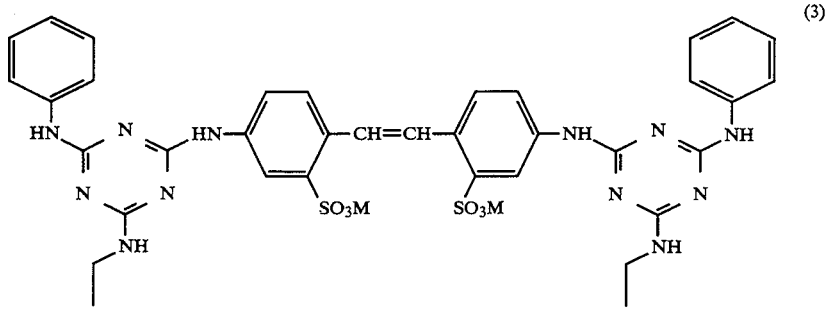

(3)

wherein M is an alkali metal ion.

Particularly preferred fluorescent whitening agents are the compounds of formula (2).

Preferred halogens are fluoro, chloro and bromo. Chloro is especially preferred.

Suitable $C_1$-$C_4$alkyl groups in the alkylamino radicals are unbranched and branched alkyl groups such as methyl, ethyl, n- and isopropyl, n-, sec- and tert-butyl. These $C_1$-$C_4$alkyl groups may themselves by substituted by aryl (phenyl, naphthyl), $C_1$-$C_4$alkoxy, OH, halogen, sulfo or CN.

Illustrative examples of salt-forming cations M are alkali metal, ammonium $$\overset{\oplus}{(NH_4)}$$

or amine salt ions. Preferred amine salt ions are those of formula $H^+NR_1R_2R_3$, wherein $R_1$, $R_2$ and $R_3$ are each independently of one another alkyl, alkenyl, hydroxyalkyl, cyanoalkyl, haloalkyl or phenylalkyl, or wherein $R_1$ and $R_2$, when taken together, complete a 5-7-membered saturated nitrogen heterocycle that may additionally contain a nitrogen or oxygen atom as ring member, conveniently a piperidino, piperazino, pyrrolidino, imidazolino or morpholino ring, and $R_3$ is hydrogen. Preferred salt-forming cations are alkali metal cations, $Na^+$ and $K^+$ being especially preferred.

One or more alkali metal salts as well as salts of lower carboxylic acids may be used as suitable electrolytes. Illustrative examples of electrolytes are sodium sulfate, sodium phosphate, sodium carbonate, sodium formate or one of the corresponding potassium salts as well as mixtures of said electrolytes, and also minor amounts of sodium chloride. Preferred electrolytes are the carbonates, phosphates and formates. The amount of electrolyte can be from 0.05 to 15% by weight, preferably 0.1 to 5% by weight and, in particular, from 0. 1 to 1.0% by weight, based on the total weight of the formulation.

The anionic polysaccarides eligible for use in the practice of this invention belong to the group of the modified polysaccharides that are derived from cellulose, starch or from the heteropolysaccharides which may contain in the side chains further monosaccharides such as mannose and glucuronic acid. Illustrative examples of anionic polysaccharides are sodium alginate, carboxymethylated guar, carboxymethyl cellulose, carboxymethyl starch, carboxymethylated carob bean flour and, most preferably, xanthane, as well as mixtures of these polysaccharides.

The amount of polysaccharide is from 0 to 1% by weight, preferably from 0 to 0.5% by weight and, most preferably, from 0.05–0.2% by weight, in each case based on the total weight of the formulation. However, these ranges may be exceeded in the preparation of formulations of very high or very low concentration.

Suitable dispersants may be those of the anionic or non-ionic type. Typical examples of such dispersants are alkylbenzenesulfonates, alkyl or alkenyl ether sulfonate salts, saturated or unsaturated fatty acids, alkyl or alkylene ether carboxylate salts, sulfonated fatty acid salts or esters, phosphate esters, polyoxyethylene alkyl or alkenyl ethers, polyoxyethylene alkyl vinyl ethers, polyoxypropylene alkyl or alkenyl ethers, polyoxybutylene alkyl or alkenyl ethers, higher fatty acid alkanolamides or alkylene oxide adducts, sucrose/fatty acid esters, fatty acid/glycol monoesters, alkylamine oxides and condensates of aromatic sulfonic acids with formaldehyde, as well as ligninsulfonates or mixtures of the above cited dispersants. The condensates of aromatic sulfonic acids with formaldehyde as well as ligninsulfonates are preferred. Condensates of naphthalenesulfonic acids or phenolsulfonic acids (benzenesulfonic acid, cresolsulfonic acid) with formaldehyde as well as ditolyl ether sulfonic acids with formaldehyde are especially preferred. These condensates are usually in the form of alkali metal, alkaline earth metal or ammonium salts.

The amount of dispersant is from 0.2 to 20% by weight, based on the total weight of the formulation, and is preferably from 0.1 to 10% by weight and, most preferably, from 0.2 to 5% by weight.

The whitener formulations of the present invention may contain further optional components. Exemplary of such further components are preservatives such as chloroacetamide, triazine derivatives or benzoisothiazolines, Mg/Al silicates, fragrances and antifreeze agents such as propylene glycol.

Mg/Al silicates are typically bentonite, montmorillonite, zeolites and highly dispersed silicic acids. They are usually added in an amount of 0.2–1% by weight, based on the total weight of the whitener formulation.

The formulations of the present invention are prepared by mixing the moist filter cakes, or also the dry powders, of the anionic fluorescent whitening agents that contain at least one sulfonic acid radical in an amount of 15 to 60% by weight, preferably 15 to 45% by weight and, most preferably, 19 to 40% by weight, based on the total weight of the formulation, with 0.01 to 1% by weight of anionic polysaccharide; 0.05 to 5% by weight of electrolyte; 0.2 to 20% by weight of dispersant; further optional components; and with water, and homogenising the formulation so obtained at room temperature or elevated temperature (20°–100° C.), conveniently by stirring or with a dissolver disc. Homogenisation may additionally be followed by an optional wet grinding.

The desired concentration of anionic fluorescent whitening agents in the suspension can be adjusted either by addition of water, aqueous electrolyte or additional dry whitener powder to the moist filter cake. This adjustment can be made before, during or after addition of the anionic polysaccharide.

The formulations of the present invention are used in particular for incorporation in detergent compositions, conveniently by running the requisite amount of novel formulation from a container into a mixing apparatus containing a suspension of the detergent composition or of the dispersant.

Accordingly, the present invention also relates to a process for the preparation of solid or liquid detergent compositions and to the detergent compositions so obtained, which comprises mixing a suspension of components customarily employed for detergents with a whitener suspension of this invention and drying the formulation so obtained. Drying may conveniently be effected by spray drying.

The whitener formulations of this invention can also be used for the preparation of liquid detergent compositions.

The invention is illustrated by the following non-limitative Examples in which percentages are based on the total weight of the formulation.

EXAMPLE 1

With stirring, the components listed below are mixed and homogenised at 20° C.:

36.0% by weight of the fluorescent whitening agent of formula (2);
0.5% by weight of NaCl;
1.0% by weight of the condensate of a ditolyl ether sulfonic acid with formaldehyde;
0.2% by weight of chloroacetamide;
0.1% of an anionic polysaccharide; and
deionised water to make up 100%.

The whitener formulations so obtained remain liquid and form no deposits after standing for 2 months at −5° C., room temperature or 40° C.

EXAMPLES 2 to 6

With stirring, the components listed below are mixed and homogenised at 20° C.:

19.0% by weight of the fluorescent whitening agent of formula (2);
5.0% by weight of NaCl;
1.3% by weight of $Na_2SO_4$;
0.01% by weight of the condensate of a ditolyl ether sulfonic acid with formaldehyde;
0.3% by weight of chloroacetamide;
0.2% of an anionic polysaccharide; and
deionised water to make up 100%.

The whitener formulations so obtained remain liquid and form no deposits after standing for 1 month at room temperature or at 40° C.

Comparable results are obtained with 0.02, 0.05, 0.10 or0.20% by weight of the condensate of a ditolyl ether sulfonic acid with formaldehyde instead of 0.01% by weight of the condensate of a ditolyl ether sulfonic acid with formaldehyde.

EXAMPLES 7 to 9

With stirring, the components listed below are mixed and homogenised at 20° C.:

19.0% by weight of the fluorescent whitening agent of formula (2);
2.0% by weight of NaCl;
0.05% by weight of the condensate of a ditolyl ether sulfonic acid with formaldehyde;
0.3% by weight of chloroacetamide;
0.2% of an anionic polysaccharide; and
deionised water to make up 100%.

The whitener formulations so obtained remain liquid and form no deposits after standing for 1 month at room temperature or at 40° C.

Comparable results are obtained with 0.10 or 0.20% by weight of the condensate of a ditolyl ether sulfonic acid with formaldehyde instead of 0.05% by weight of the condensate of a ditolyl ether sulfonic acid with formaldehyde.

EXAMPLES 10 and 11

With stirring, the components listed below are mixed and homogenised at 20° C.:

40.0% by weight of the fluorescent whitening agent of formula (2);
1.05% by weight of NaCl;
0.25% by weight of the condensate of a ditolyl ether sulfonic acid with formaldehyde; and
deionised water to make up 100%.

The whitener formulations so obtained remain liquid and form no deposits after standing for 1 month at room temperature.

Comparable results are obtained with 0.34% by weight of the condensate of a ditolyl ether sulfonic acid with formaldehyde instead of 0.25% by weight of the condensate of a ditolyl ether sulfonic acid with formaldehyde.

EXAMPLES 12 to 14

With stirring, the components listed below are mixed and homogenised at 20° C.:

40.0% by weight of the fluorescent whitening agent of formula (2);
2.1% by weight of NaCl;
0.17% by weight of the condensate of a ditolyl ether sulfonic acid with formaldehyde; and
deionised water to make up 100%.

The whitener formulations so obtained remain liquid and form no deposits after standing for 1 month at room temperature.

Comparable results are obtained with 0.25 or 0.34% by weight of the condensate of a ditolyl ether sulfonic acid with formaldehyde instead of 0.17% by weight of the condensate of a ditolyl ether sulfonic acid with formaldehyde.

EXAMPLES 15 to 18

With stirring, the components listed below are mixed and homogenised at 20° C.:

40.0% by weight of the fluorescent whitening agent of formula (2);
5.3% by weight of NaCl;
0.08% by weight of the condensate of a ditolyl ether sulfonic acid with formaldehyde; and
deionised water to make up 100%.

The whitener formulations so obtained remain liquid and form no deposits after standing for 1 month at room temperature.

Comparable results are obtained with 0.17, 0.25 or 0.34% by weight of the condensate of a ditolyl ether sulfonic acid with formaldehyde instead of 0.08% by weight of the condensate of a ditolyl ether sulfonic acid with formaldehyde.

What is claimed is:

1. A storage-stable whitener formulation comprising a) 15 to 60% by weight, based on the total weight of the formulation, of a fluorescent whitening agent having the formula ( 1)

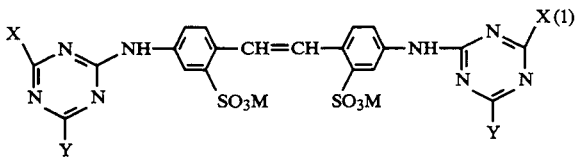

X(1)

wherein X and Y may be identical or different and are a mono- or di-substituted amino group or an unsubstituted, mono- or di-substituted alkoxy group, and M is a hydrogen atom or a salt-forming cation;

b) 0.1 to 15% by weight, based on the total weight of the formulation, of an electrolyte or a mixture of electrolytes;

c) 0.05 to 1% by weight, based on the total weight of the formulation, of an anionic polysaccharide or mixture of polysaccharides;

d) 0.01 to 10% by weight, based on the total weight of the formulation, of one or more than one anionic dispersant, wherein the dispersant is a condensate of an aromatic sulfonic acid with formaldehyde or a mixture thereof; and e) water.

2. A storage-stable whitener formulation according to claim 1, which contains 15 to 40% by weight of fluorescent whitening agent.

3. A storage-stable whitener formulation according to claim 1, which contains 0.1 to 2% by weight of electrolyte.

4. A storage-stable whitener formulation according to claim I, which contains 0.1 to 10% by weight of dispersant.

5. A storage-stable whitener formulation according to claim 1, which contains 0.2 to 1% by weight of a Mg/Al silicate as additional component, based on the total weight of the formulation.

6. A storage-stable whitener formulation according to claim 5, wherein the Mg/Al silicate is bentonite.

7. A storage-stable whitener formulation according to claim 6, which contains 0.2 to 1% by weight of bentonite, based on the total weight of the formulation, as additional component.

8. A storage-stable whitener formulation according to claim 1, wherein the anionic polysaccharide is a modified polysaccharide that is derived from cellulose, starch or from heteropolysaccharides.

9. A storage-stable whitener formulation according to claim 8, wherein the modified polysaccharide is a cellulose derivative.

10. A storage-stable whitener formulation according to claim 9, wherein the dispersant is a condensate of a naphthalenesulfonic acid with formaldehyde or of a ditolyl ether sulfonic acid with formaldehyde.

11. A storage-stable whitener formulation according to claim 1, wherein the dispersant is a condensate of a naphthalenesulfonic acid with formaldehyde or of a ditolyl ether sulfonic acid with formaldehyde.

12. A storage-stable whitener formulation according to claim 1, in which the fluorescent whitening agent has the formula (2) or (3)

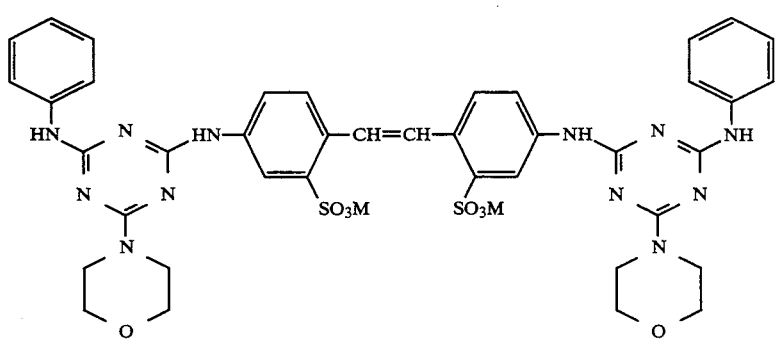

(2)

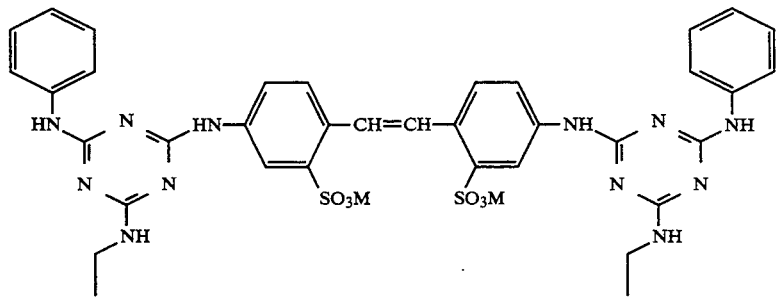

(3)

wherein M is an alkali metal ion.

13. A storage-stable whitener formulation according to claim 1, which contains 0.05 to 0.2% by weight of polysaccharide.

* * * * *